US010032462B2

(12) United States Patent
Pandey et al.

(10) Patent No.: US 10,032,462 B2
(45) Date of Patent: Jul. 24, 2018

(54) METHOD AND SYSTEM FOR SUPPRESSING NOISE IN SPEECH SIGNALS IN HEARING AIDS AND SPEECH COMMUNICATION DEVICES

(71) Applicant: Indian Institute of Technology Bombay, Powai, Mumbai, Maharashtra (IN)

(72) Inventors: Prem Chand Pandey, Mumbai (IN); Nitya Tiwari, Mumbai (IN)

(73) Assignee: Indian Institute of Technology Bombay, Mumbai (IN)

( * ) Notice: Subject to any disclaimer, the term of this patent is extended or adjusted under 35 U.S.C. 154(b) by 0 days.

(21) Appl. No.: 15/303,435

(22) PCT Filed: Apr. 24, 2015

(86) PCT No.: PCT/IN2015/000183
§ 371 (c)(1),
(2) Date: Oct. 11, 2016

(87) PCT Pub. No.: WO2016/135741
PCT Pub. Date: Sep. 1, 2016

(65) Prior Publication Data

US 2017/0032803 A1 Feb. 2, 2017

(30) Foreign Application Priority Data

Feb. 26, 2015 (IN) ..... 640/MUM/2015

(51) Int. Cl.
*G10L 21/02* (2013.01)
*G10L 21/0208* (2013.01)
(Continued)

(52) U.S. Cl.
CPC ..... *G10L 21/0388* (2013.01); *G10L 19/022* (2013.01); *G10L 21/0208* (2013.01);
(Continued)

(58) Field of Classification Search
CPC . G10L 21/02; G10L 21/0205; G10L 21/0208; G10L 21/0216; G10L 21/0232; G10L 21/0264; H04R 2225/43
(Continued)

(56) References Cited

U.S. PATENT DOCUMENTS 4,379,948 A * 4/1983 Ney ..... G10L 15/00 704/203
6,893,235 B2 5/2005 Carlin et al.
(Continued)

FOREIGN PATENT DOCUMENTS

GB 2426167 B 3/2007
WO 2012158156 A1 11/2012

OTHER PUBLICATIONS

Fu, Qiang, and Eric A. Wan. "Perceptual wavelet adaptive denoising of speech." INTERSPEECH. Oct. 2003, pp. 1-4.*
(Continued)

*Primary Examiner* — James Wozniak
(74) *Attorney, Agent, or Firm* — Pepper Hamilton LLP

(57) ABSTRACT

A method for speech enhancement in speech communication devices and more specifically in hearing aids for suppressing stationary and non-stationary background noise in the input speech signal signals is disclosed. The method uses spectral subtraction wherein the noise spectrum is updated using quantile-based estimation without voice activity detection and the quantile values are approximated by dynamic quantile tracking without involving large storage and sorting of past spectral samples. The technique permits use of a different quantile at each frequency bin for noise estimation without introducing processing overheads. The preferred embodiment uses analysis-modification-synthesis based on Fast Fourier transform (FFT) and it can be integrated with other FFT-based signal processing techniques used in the hearing aids and speech communication devices. A noise
(Continued)

suppression system based on this method and using hardware with an audio codec and a digital signal processor chip with on-chip FFT hardware is also disclosed.

13 Claims, 7 Drawing Sheets

(51) Int. Cl.

| | |
|---|---|
| ***G10L 21/0264*** | (2013.01) |
| ***G10L 21/0388*** | (2013.01) |
| ***G10L 21/0232*** | (2013.01) |
| ***G10L 19/022*** | (2013.01) |
| *H04R 25/00* | (2006.01) |

(52) U.S. Cl.
CPC ..... *G10L 21/0232* (2013.01); *G10L 21/0264* (2013.01); *H04R 25/505* (2013.01); *H04R 2225/41* (2013.01); *H04R 2225/43* (2013.01); *H04R 2430/03* (2013.01); *H04R 2460/01* (2013.01)

(58) Field of Classification Search
USPC ..... 704/226–227; 381/317
See application file for complete search history.

(56) References Cited

U.S. PATENT DOCUMENTS

| | | | | |
|---|---|---|---|---|
| 7,596,495 | B2 | 9/2009 | Kazama et al. | |
| 8,239,194 | B1 * | 8/2012 | Paniconi | G10L 21/0216 381/71.1 |
| 8,364,479 | B2 | 1/2013 | Schmidt et al. | |
| 8,666,737 | B2 | 3/2014 | Nakajima et al. | |
| 9,185,487 | B2 * | 11/2015 | Solbach | H04R 3/005 |
| 2002/0026539 | A1 | 2/2002 | Muthukumaraswamy et al. | |
| 2006/0041895 | A1 * | 2/2006 | Berreth | G06F 13/102 719/328 |
| 2006/0253283 | A1 * | 11/2006 | Jabloun | G10L 25/78 704/233 |
| 2007/0055508 | A1 * | 3/2007 | Zhao | H04R 25/55 704/226 |
| 2009/0110209 | A1 * | 4/2009 | Li | H04R 3/04 381/73.1 |
| 2009/0185704 | A1 * | 7/2009 | Hockley | G10L 17/26 381/316 |
| 2010/0027820 | A1 | 2/2010 | Kates | |
| 2011/0010337 | A1 | 1/2011 | Bu et al. | |
| 2011/0231185 | A1 | 9/2011 | Kleffner et al. | |
| 2012/0195397 | A1 | 8/2012 | Sayana et al. | |
| 2012/0197636 | A1 * | 8/2012 | Benesty | G10L 21/0232 704/226 |
| 2012/0209612 | A1 | 8/2012 | Bilobrov | |

OTHER PUBLICATIONS

International Search Report dated Oct. 23, 2015 (Oct. 23, 2015) in corresponding International Patent Application No. PCT/IN2015/000183.

J. Makhoul, "Enhancement of speech corrupted by acoustic noise," Proc. IEEE ICASSP 1979, pp. 208-211.

S. F. Boll, "Suppression of acoustic noise in speech using spectral subtractions," IEEE Trans. Acoust., Speech, Signal Process., vol. 27, No. 2, pp. 113-120, 1979.

P. C. Loizou, "Speech Enhancement: Theory and Practice," CRC Press, 2007.

R. Martin, "Spectral substraction based on minimum statistics," Proc. EUSIPCO 1994, pp. 1182-1185.

I. Cohen, "Noise Spectrum estimation in adverse environments: improved minima controlled recursive averaging," IEEE. Trans. Speech Audio Process., vol. 11, No. 5, pp. 466-475, 2003.

G. Doblinger, "Computationally efficient speech enhancement by spectral minima tracking in subbands," Proc. 1995, EUROSPEECH pp. 1513-1516.

Stahl et al., "Quantile based noise estimation for spectral subtraction and Wiener filtering," Proc. IEEE ICASSP, 2000, pp. 1875-1878.

N. W. Evans and J. S. Mason, "Time-frequency quantile-based noise estimation," Proc. EUSIPCO 2002, pp. 539-542.

S. K. Waddi, P.C. Pandey, and N. Tiwari, "Speech enhancement using spectral subtraction and cascaded-median based noise estimation for hearing impaired listeners," Proc. NCC 2013, paper No. 1569696063.

ITU, "Perceptual evaluation of speech quality (PESQ): An objective method for end-to-end speech quality assessment of narrow-band telephone networks and speech codecs," ITU-T Rec., p. 862, 2001.

* cited by examiner

METHOD AND SYSTEM FOR SUPPRESSING NOISE IN SPEECH SIGNALS IN HEARING AIDS AND SPEECH COMMUNICATION DEVICES

CROSS REFERENCE TO RELATED APPLICATIONS

This application is a national phase filing under 35 U.S.C. § 371 of International Patent Application No. PCT/IN2015/000183, filed Apr. 24, 2015, which claims the benefit of Indian Patent Application No. 640/MUM/2015, filed Feb. 26, 2015, each of which is incorporated herein by reference in its entirety.

FIELD OF THE INVENTION

The present disclosure relates to the field of signal processing in hearing aids and speech communication devices, and more specifically relates to a method and system for suppressing background noise in the input speech signal, using spectral subtraction wherein the noise spectrum is updated using quantile based estimation and the quantile values are approximated using dynamic quantile tracking.

BACKGROUND OF THE INVENTION

Sensorineural loss is caused by degeneration of the sensory hair cells of the inner ear or the auditory nerve. Persons with such loss experience severe difficulty in speech perception in noisy environments. Suppression of wide-band non-stationary background noise as part of the signal processing in hearing aids and other speech communication devices can serve as a practical solution for improving speech quality and intelligibility for persons with sensorineural or mixed hearing loss. Many signal processing techniques developed for improving speech perception require noise-free speech signal as the input and these techniques can benefit from noise suppression as a pre-processing stage. Noise suppression can also be used for improving the performance of speech codecs, speech recognition systems, and speaker recognition systems under noisy conditions.

For implementing the noise suppression on a low-power processor in a hearing aid or a communication device, the technique should have low algorithmic delay and low computational complexity. Spectral subtraction (M. Berouti, R. Schwartz, and J. Makhoul, "Enhancement of speech corrupted by acoustic noise," Proc. IEEE ICASSP 1979, pp. 208-211; S. F. Boll, "Suppression of acoustic noise in speech using spectral subtraction," IEEE Trans. Acoust., Speech, Signal Process., vol. 27, no. 2, pp. 113-120, 1979) can be used as a single-input speech enhancement technique for this application. A large number of variations of the basic technique have been developed for use in audio codecs and speech recognition (P. C. Loizou, "Speech Enhancement: Theory and Practice," CRC Press, 2007). The processing steps are segmentation and spectral analysis, estimation of the noise spectrum, calculation of the enhanced magnitude spectrum, and re-synthesis of the speech signal. Due to non-stationary nature of the interfering noise, its spectrum needs to be dynamically estimated. Under-estimation of the noise results in residual noise and over-estimation results in distortion leading to degraded quality and reduced intelligibility. Noise can be estimated during the silence intervals identified by a voice activity detector, but the detection may not be satisfactory under low SNR conditions and the method may not correctly track the noise spectrum during long speech segments.

Several techniques based on minimum statistics for estimating the noise spectrum, without voice activity detection, have been reported (R. Martin, "Spectral subtraction based on minimum statistics," Proc. EUSIPCO 1994, pp. 1182-1185; I. Cohen, "Noise spectrum estimation in adverse environments: improved minima controlled recursive averaging," IEEE Trans. Speech Audio Process., vol. 11, no. 5, pp. 466-475, 2003; G. Doblinger, "Computationally efficient speech enhancement by spectral minima tracking in subbands," Proc. EUROSPEECH 1995, pp. 1513-1516). These techniques involve tracking the noise (as minima of the magnitude spectra of the past frames and are suitable for real-time operation. However, they often underestimate the noise and need estimation of an SNR-dependent subtraction factor. In the absence of significant silence segments, processing may remove some parts of the speech signal during the weaker speech segments. Stahl et al. (V. Stahl, A. Fisher, and R. Bipus, "Quantile based noise estimation for spectral subtraction and Wiener filtering," Proc. IEEE ICASSP 2000, pp. 1875-1878) reported that a quantile-based estimation of the noise spectrum from the spectrum of the noisy speech can be used for spectral subtraction based noise suppression. It is based on the observation that the signal energy in a particular frequency bin is low in most of the frames and high only in 10-20% frames corresponding to voiced speech segments. For improving word accuracy in a speech recognition task, a time-frequency quantile based noise estimation was reported by Evans and Mason (N. W. Evans and J. S. Mason, "Time-frequency quantile-based noise estimation," Proc. EUSIPCO 2002, pp. 539-542). These quantile-based noise estimation techniques use quantiles obtained by ordering the spectral samples or from dynamically generated histograms. Due to large memory space required for storing the spectral samples and high computational complexity, they are not suited for use in hearing aids and communication devices. Use of median, i.e. 0.5-quantile, considerably reduces the computation requirement, but still does not permit real-time implementation. Waddi et al. (S. K. Waddi, P. C. Pandey, and N. Tiwari, "Speech enhancement using spectral subtraction and cascaded-median based noise estimation for hearing impaired listeners," Proc. NCC 2013, paper no. 1569696063) used a cascaded-median as an approximation to median for real-time implementation of speech enhancement. The improvements in speech quality were found to be different for different types of noises, indicating the need for using frequency-bin dependent quantiles for suppression of non-white and non-stationary noises.

Kazama et al. (M. Kazama, M. Tohyama, and T. Hirai, "Current noise spectrum estimation method and apparatus with correlation between previous noise and current noise signal," U.S. Pat. No. 7,596,495 B2, 2009) have disclosed a method for updating the noise spectrum based on the correlation between the envelope of previously estimated noise spectrum and the envelope of the current spectrum of the input. It has high computational complexity due to the need for calculating the spectral envelopes and the correlation. As all the spectral samples of the noise are updated using a single mixing ratio, the method may not be effective in suppressing non-stationary non-white noises.

In a noise suppression method disclosed by Schmidt et al. (G. U. Schmidt, T. Wolff, and M. Buck, "System for speech signal enhancement in a noisy environment through corrective adjustment of spectral noise power density estimations," U.S. Pat. No. 8,364,479 B2, 2013), the noise spectrum is estimated using moving average and minimum statistics and a frequency-dependent correction factor is obtained using the variance of relative spectral noise power density estimation error, estimated noise spectrum, and the input spectrum. The relative spectral noise power density estimation error is calculated during non-speech frames whose identification requires a voice activity detector and minimum statistics based noise estimation requires an SNR-dependent subtraction factor, leading to increased computational complexity.

In a method for estimating noise spectrum using quantile-based noise estimation, disclosed by Jabloun (F. Jabloun "Quantile based noise estimation," UK patent No. GB 2426167 A, 2006), spectra of a fixed number of past input frames are stored in a buffer and sorted using a fast sorting algorithm for obtaining the specified quantile value for each spectral sample. A recursive smoothening is applied on the quantile-estimated noise spectrum, using smoothening parameter calculated from the estimated frequency-dependent SNR. Although the method does not need a voice activity detector, it requires a large memory for buffering the spectra. For reducing the high computational complexity due to sorting operations, the quantile computations are restricted to a small number of frequency samples and the noise spectrum is obtained using interpolation, restricting the effectiveness of the method in case of non-stationary non-white noise.

Nakajima et al. (H. Nakajima, K. Nakadai, and Y. Hasegawa, "Noise power estimation system, noise power estimating method, speech recognition system and speech recognizing method," U.S. Pat. No. 8,666,737 B2, 2014) have described a method for estimating the noise spectrum using a cumulative histogram for each spectral sample which is updated at each analysis window using a time decay parameter. Although the method does not require large memory for buffering the spectra, it has high computational complexity and the estimated quantile values can have large errors in case of non-stationary noise.

Thus for noise signal suppression in speech signals in hearing aids and speech communication devices, there is a need to mitigate the disadvantages associated with the methods and systems described above. Particularly, there is a need for noise signal suppression without involving voice activity detection and without needing large memory and high computational complexity.

OBJECT OF THE INVENTION

1. It is the primary object of the present disclosure to provide a method and system for noise suppression in hearing aids and speech communication devices, wherein the noise spectrum is estimated using dynamic quantile tracking.
2. It is another object of the present disclosure to provide a noise suppression system and method for real-time processing without involving large memory for storage and sorting of the past spectral samples.

SUMMARY OF THE INVENTION

The present disclosure describes a method and a system for speech enhancement in speech communication devices and more specifically in hearing aids for suppressing stationary and non-stationary background noise in the input speech signal. The method uses spectral subtraction wherein the noise spectrum is updated using quantile-based estimation without voice activity detection and the quantile values are approximated using dynamic quantile tracking without involving large storage and sorting of past spectral samples. The technique permits use of a different quantile at each frequency bin for noise estimation without introducing processing overheads. The preferred embodiment uses analysis-synthesis based on Fast Fourier transform (FFT) and it can be integrated with other FFT-based signal processing techniques like dynamic range compression, spectral shaping, and signal enhancement used in the hearing aids and speech communication devices. A noise suppression system based on this method and using hardware with an audio codec and a digital signal processor (DSP) chip with on-chip FFT hardware is also disclosed.

DETAILED DESCRIPTION OF THE INVENTION

The present disclosure discloses a method for noise suppression using spectral subtraction wherein the noise spectrum is dynamically estimated without voice activity detection and without storage and sorting of past spectral samples. It also discloses a system using this method for speech enhancement in hearing aids and speech communication devices, for improving speech quality and intelligibility. The disclosed method is suited for implementation using low power processors and the signal delay is small enough to be acceptable for audio-visual speech perception.

In the short-time spectrum of speech signal mixed with background noise, the signal energy in a frequency bin is low in most of the frames and high only in 10-20% frames corresponding to voiced speech segments. Therefore, the spectral samples of the noise spectrum are updated using quantile-based estimation without using voice activity detection. A technique for dynamic quantile tracking is used for approximating the quantile values without involving storage and sorting of past spectral samples. The technique permits use of a different quantile at each frequency bin for noise estimation without introducing processing overheads.

Figure 1:
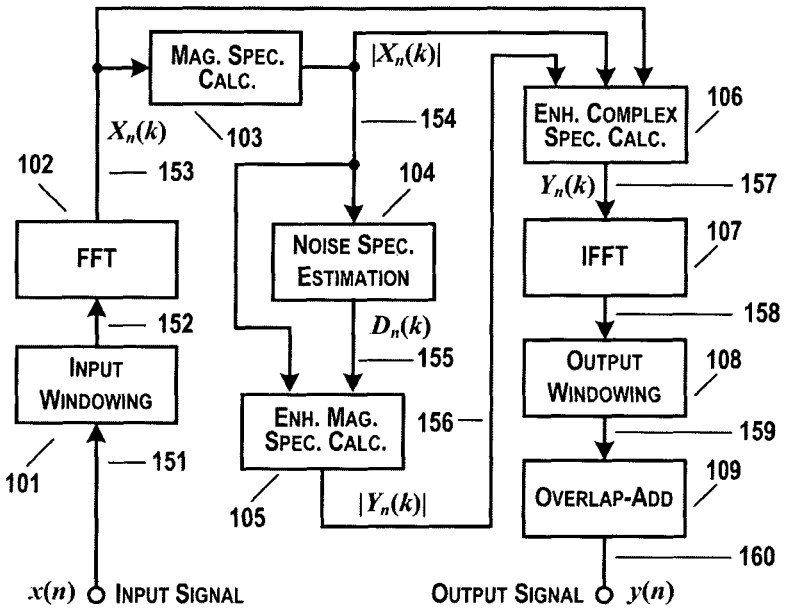
FIG. 1 is a schematic illustration of noise suppression by spectral subtraction.

The processing involves noise suppression by spectral subtraction, using analysis-modification-synthesis and comprising the steps of short-time spectral analysis, estimation of the noise spectrum, calculation of the enhanced magnitude spectrum, and re-synthesis of the output signal. The preferred embodiment uses FFT-based analysis-modification-synthesis along with overlapping analysis windows or frames. FIG. 1 is a schematic illustration of the method for processing the digitized input consisting of the speech signal mixed with the background noise. The short-time spectral analysis comprises the input windowing block (101) for producing overlapping windowed segments of the digitized input signal, the FFT block (102) for calculating the complex spectrum, and the magnitude spectrum calculation block (103) for calculating the magnitude spectrum of the overlapping windowed segments. The noise spectrum estimation block (104) estimates the noise spectrum using dynamic quantile tracking of the input magnitude spectral samples. The enhanced magnitude spectrum calculation block (105) smoothens the estimated noise spectrum and calculates the enhanced magnitude spectrum by applying spectral subtraction. The resynthesis comprises the enhanced complex spectrum calculation block (106) for calculating the enhanced complex spectrum without explicit phase estimation, the inverse fast Fourier transform (IFFT) block (107) for calculating segments of the enhanced signal, the output windowing block (108) for windowing the enhanced segments, and the overlap-add block (109) for producing the output signal.

The digitized input signal x(n) (151) is applied to the input windowing block (101) which outputs overlapping windowed segments (152). These segments serve as the input analysis frames for the FFT block (102) which calculates the complex spectrum $X_n(k)$ (153), with k referring to frequency sample index. The magnitude spectrum calculation block (103) calculates the magnitude spectrum $|X_n(k)|$ (154). The noise estimation block (104) uses magnitude spectrum $|X_n(k)|$ (154) to estimate noise spectrum $D_n(k)$ (155) using dynamic quantile tracking. The enhanced magnitude spectrum calculation block (105) uses the magnitude spectrum $|X_n(k)|$ (154) and the estimated noise spectrum $D_n(k)$ (155) as the inputs and calculates the enhanced magnitude spectrum $|Y_n(k)|$ (156). In this block (105), the estimated noise spectrum $D_n(k)$ (155) is smoothened by applying an averaging filter along the frequency axis. The smoothened noise spectrum $D_n'(k)$ is calculated using a (2b+1)—sample filter, realized recursively for computational efficiency, as the following:

$$D_n'(k)=D_n'(k-1)+[D_n(k+b)-D_n(k-b-1)]/(2b+1) \quad (1)$$

The smoothened noise spectrum $D_n'(k)$ is used for calculating the enhanced magnitude spectrum $|Y_n(k)|$ (156) using the generalized spectral subtraction as the following:

$$|Y_n(k)| = \begin{cases} \beta^{1/\gamma} D_n'(k), & |X_n(k)| < (\alpha+\beta)^{1/\gamma} D_n'(k) \\ [|X_n(k)|^\gamma - \alpha(D_n'(k))^\gamma]^{1/\gamma}, & \text{otherwise} \end{cases} \quad (2)$$

The exponent factor γ may be selected as 2 for power subtraction or as 1 for magnitude subtraction. Choosing subtraction factor α>1 helps in reducing the broadband peaks in the residual noise, but it may result in deep valleys, causing warbling or musical noise which is masked by a floor noise controlled by the spectral floor factor β.

The enhanced complex spectrum calculation block (106) uses the complex spectrum $X_n(k)$ (153), magnitude spectrum $|X_n(k)|$ (154), and enhanced magnitude spectrum $|Y_n(k)|$ (156) as the inputs and calculates the enhanced complex spectrum $Y_n(k)$ (157). In spectral subtraction for noise suppression, the output complex spectrum is obtained by associating the enhanced magnitude spectrum with the phase spectrum of the input signal. To avoid phase computation, the enhanced complex spectrum calculation block (106) calculates the enhanced complex spectrum $Y_n(k)$ (157) as the following:

$$Y_n(k)=|Y_n(k)|X_n(k)/|X_n(k)| \quad (3)$$

The IFFT block (107) takes $Y_n(k)$ (157) as the input and calculates time-domain enhanced signal (158) which is windowed by the output windowing block (108) and the resulting windowed segments (159) are applied as input to the overlap-add block (109) for re-synthesis of the output signal y(n) (160).

In signal processing using short-time spectral analysis-modification-synthesis, the input analysis window is selected with the considerations of resolution and spectral leakage. Spectral subtraction involves association of the modified magnitude spectrum with the phase spectrum of the input signal to obtain the complex spectrum of the output signal. This non-linear operation results in discontinuities in the signal segments corresponding to the modified complex spectra of the consecutive frames. Overlap-add in the synthesis along with overlapping analysis windows is used for masking these discontinuities. A smooth output window function in the synthesis can be applied for further masking these discontinuities. The input analysis window iv' (n) and the output synthesis window $w_2(n)$ should be such that the sum of $w_1(n)w_2(n)$ for all the overlapped samples is unity, i.e.:

$$\sum_i w_1(n-iS)w_2(n-iS) = 1 \quad (4)$$

where S is the number of samples for the shift between successive analysis windows. To limit the error due to spectral leakage, a smooth symmetric window function, such as Hamming window, Hanning window, or triangular window, is used as $w_1(n)$ and rectangular window is used as $w_2(n)$. The requirement as given in Equation-4 is met by using 50% overlap in the window positions, i.e. window shift S=L/2 for window length of L samples. Alternatively, a rectangular window as $w_1(n)$ and a smooth window as $w_2(n)$ with 50% overlap are used for masking the discontinuities in the output. In order to limit the error due to spectral leakage and to mask the discontinuities in the consecutive output frames, processing is carried out using a modified Hamming window as the following:

$$w_1(n)=w_2(n)=[1/\sqrt{(4d^2+2e^2)}][d+e\cos(2\pi(n+0.5)/L)] \quad (5)$$

with d=0.54 and e=0.46. The requirement as given in Equation-4 is met by using 75% overlap in window positioning, i.e. S=L/4. FFT size N is selected to be larger than the window length L and the analysis frame as input for FFT calculation is obtained by padding the windowed segment with N−L zero-valued samples.

The noise spectrum estimation block (104) in FIG. 1 uses a dynamic quantile tracking technique for obtaining an approximation to the quantile value for each frequency bin. In this technique, the quantile is estimated at each frame by applying an increment or a decrement on the previous estimate. The increment and decrement are selected to be a fraction of the range such that the estimate after a sufficiently large number of input frames matches the sample quantile. As the underlying distribution of the spectral samples is unknown, the range also needs to be dynamically estimated.

Let the kth spectral sample of the noise spectrum $D_n(k)$ be estimated as the p(k)-quantile of the magnitude spectrum $|X_n(k)|$. It is tracked dynamically as $$D_n(k)=D_{n-S}(k)+d_n(k) \tag{6}$$

where S is the number of samples for the shift between successive analysis frames and the change $d_n(k)$ is given as $$d_n(k)=\begin{cases}\Delta_+(k), & |X_n(k)|\geq D_{n-S}(k)\\ -\Delta_-(k), & \text{otherwise}\end{cases} \tag{7}$$

The values of $\Delta_+(k)$ and $\Delta_-(k)$ should be such that the quantile estimate approaches the sample quantile and sum of the changes in the estimate approaches zero, i.e. $\Sigma d_n(k)\approx 0$. For a stationary input and number of frames M being sufficiently large, $d_n(k)$ is expected to be $-\Delta_-(k)$ for p(k)M frames and $\Delta_+(k)$ for (1−p(k))M frames. Therefore, $$(1-p(k))M\Delta_+(k)-p(k)M\Delta_-(k)\approx 0 \tag{8}$$

Thus the ratio of the increment to the decrement should satisfy the following condition:

$$\Delta_+(k)/\Delta_-(k)=p(k)/(1-p(k)) \tag{9}$$

and therefore $\Delta_+(k)$ and $\Delta_-(k)$ may be selected as $$\Delta_+(k)=\lambda p(k)R \tag{10}$$

$$\Delta_-(k)=\lambda(1-p(k))R \tag{11}$$

where R is the range (difference between the maximum and minimum values of the sequence of spectral values in a frequency bin) and λ is a factor which controls the step size during tracking. As the sample quantile may be overestimated by $\lambda_+(k)$ or underestimated by $\lambda_-(k)$, the ripple in the estimated value is given as $$\begin{aligned}\delta &= \Delta_+(k)+\Delta_-(k)\\ &= \lambda R\end{aligned} \tag{12}$$

During tracking, the number of steps needed for the estimated value to change from initial value $D_i(k)$ to final value $D_f(k)$ is given as $$s=\max\left[\frac{D_f(k)-D_i(k)}{\Delta_+(k)},\ \frac{D_i(k)-D_f(k)}{\Delta_-(k)}\right] \tag{13}$$

Since $(|D_f(k)-D_i(k)|)_{max}=R$, the maximum number of steps is given as $$s_{max}=\max\left[\frac{1}{\lambda p(k)},\ \frac{1}{\lambda(1-p(k))}\right] \tag{14}$$

The factor λ can be considered as the convergence factor and its value is selected for an appropriate tradeoff between δ and $s_{max}$. It may be noted that the convergence becomes slow for very low or high values of p(k).

The range is estimated using dynamic peak and valley detectors. The peak $P_n(k)$ and the valley $V_n(k)$ are updated, using the following first-order recursive relations:

$$P_n(k)=\begin{cases}\tau P_{n-S}(k)+(1-\tau)|X_n(k)|, & |X_n(k)|\geq P_{n-S}(k)\\ \sigma P_{n-S}(k)+(1-\sigma)V_{n-S}(k), & \text{otherwise}\end{cases} \tag{15}$$

$$V_n(k)=\begin{cases}\tau V_{n-S}(k)+(1-\tau)|X_n(k)|, & |X_n(k)|\leq V_{n-S}(k)\\ \sigma V_{n-S}(k)+(1-\sigma)P_{n-S}(k), & \text{otherwise}\end{cases} \tag{16}$$

The constants τ and σ are selected in the range [0, 1] to control the rise and fall times of the detection. As the peak and valley samples may occur after long intervals, τ should be small to provide fast detector responses to an increase in the range and σ should be relatively large to avoid ripples.

The range is tracked as:

$$R_n(k)=P_n(k)-V_n(k) \tag{17}$$

The dynamic quantile tracking for estimating the noise spectrum can be written as the following:

$$D_n(k)=\begin{cases}D_{n-S}(k)+\lambda p(k)R_n(k), & |X_n(k)|\geq D_{n-S}(k)\\ D_{n-S}(k)-\lambda(1-p(k))R_n(k), & \text{otherwise}\end{cases} \tag{18}$$

Figure 2:
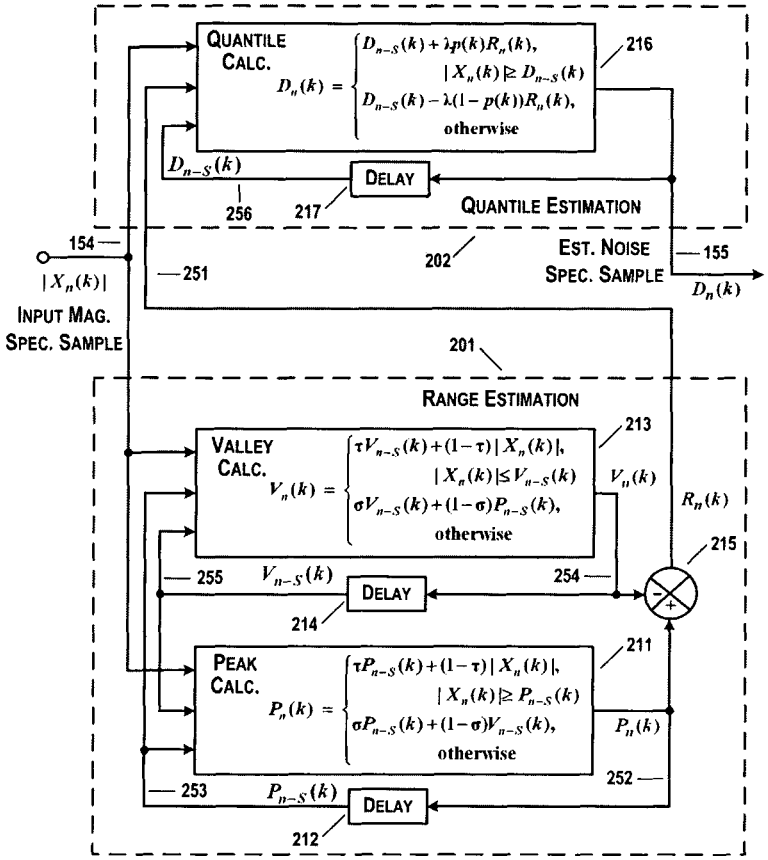
FIG. 2 is a schematic illustration of the dynamic quantile tracking technique used for estimation of the noise spectral samples.

FIG. 2 shows the block diagram of the technique for dynamic quantile tracking, which is used as the noise spectrum estimation block (104) in FIG. 1. It has two main blocks (marked by dotted outlines). The range estimation block (201) receives the input magnitude spectral sample $|X_n(k)|$ (154) as the input and outputs the estimated range of the noise spectral sample $R_n(k)$ (251). The quantile estimation block (202) receives $|X_n(k)|$ (154) and $R_n(k)$ (251) as the inputs and outputs the estimated noise spectral sample $D_n(k)$ (155). In the range estimation block (201), the peak calculator (211) calculates the peak $P_n(k)$ (252) using Equation-15 and output of the delay (212). The valley calculator (213) calculates the valley $V_n(k)$ (254) using Equation-16 and output of the delay (214). The range $R_n(k)$ (251) is calculated by the difference block (215) using Equation-17. In the quantile estimation block (202), the quantile calculator (216) calculates $D_n(k)$ (155) using Equation-18 and output of the delay (217).

A noise suppression system using the above disclosed method is implemented using hardware consisting of an audio codec and a low-power digital signal processor (DSP) chip for real-time processing of the input signal for use in aids for the hearing impaired and also in other speech communication devices.

Figure 3:
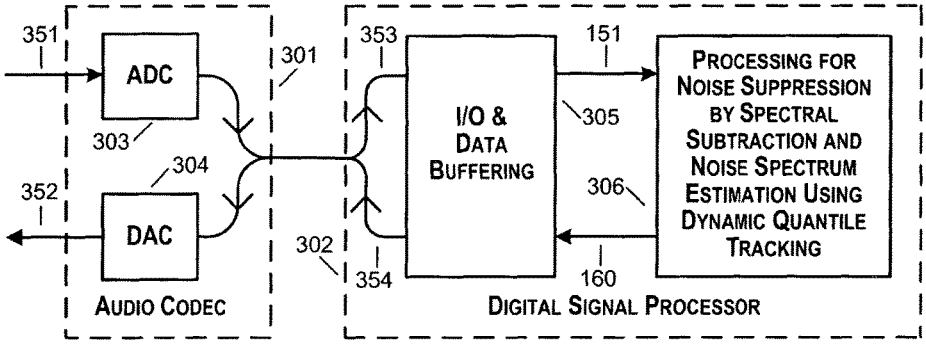
FIG. 3 shows a block diagram of the preferred embodiment of the noise suppression system implemented using an audio codec and a DSP chip in accordance with an aspect of the present disclosure.

FIG. 3 shows a block diagram of the preferred embodiment of the system. It has two main blocks (marked by dotted outlines). The audio codec (301) comprises of ADC (303) and DAC (304). The digital signal processor (302) comprises of the input/output (I/O) and data buffering block (305) based on direct memory access (DMA) and the processing block (306) for noise suppression by spectral subtraction and noise spectrum estimation using dynamic quantile tracking. The analog input signal (351) is converted into digital samples (353) by the ADC (303) of the audio codec (301) at the selected sampling frequency. The digital samples (353) are buffered by the I/O block (305) and applied as input (151) to the processing block (306). The processed output samples (160) from the processing block (306) are buffered by the I/O and data buffering block (305) and are applied as the input (354) to DAC (304) of the audio codec (301) which generates the analog output signal (352). The processing block (306) is an implementation of the noise suppression method as schematically presented in FIG. 1. The processing block can be realized as a program running on the hardware of a DSP chip or as a dedicated hardware. The processing for noise estimation, spectral subtraction, and re-synthesis of the output signal has to be implemented with due care to avoid overflows.

Figure 4:
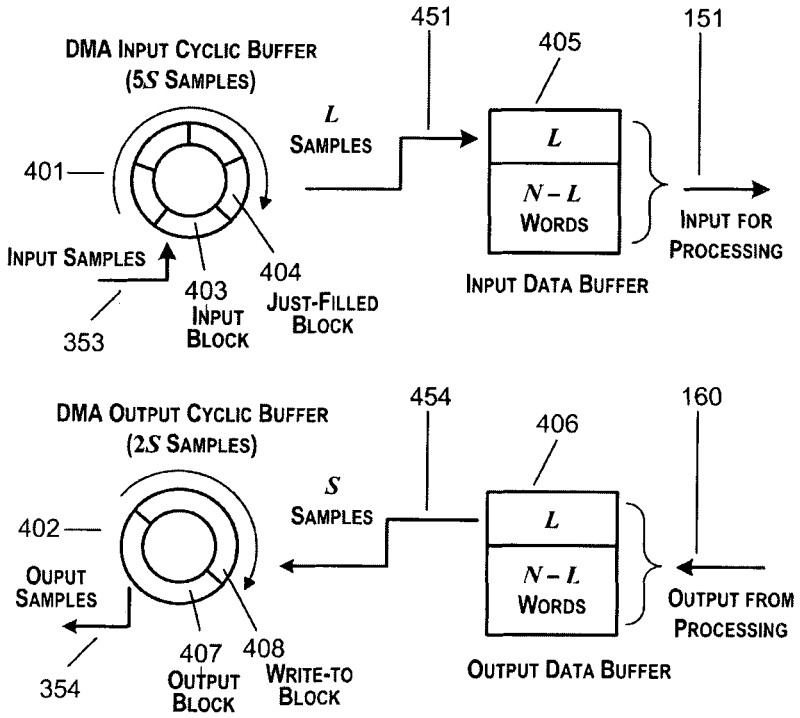
FIG. 4 shows data transfer and buffering operations on the DSP chip using DMA-based input-output and cyclic buffers (S=L/4) in accordance with an aspect of the present disclosure.

FIG. 4 shows the input, output, data transfer, and buffering operations devised for an efficient realization of the processing with 75% overlap and zero padding. It uses L-sample analysis window and N-point FFT. The input digital samples (151) are read in using a 5-block DMA input cyclic buffer (401) and the processed samples are written out using a 2-block DMA output cyclic buffer (402), with S-word blocks and S=L/4. To keep a track of the current input block (403), just-filled input block (404), current output block (407), and write-to output block (408), cyclic pointers are used. The pointers are initialized to 0, 4, 0, and 1, respectively and are incremented at every DMA interrupt generated when a block gets filled. The DMA-mediated reading of the input digital samples (353) into the current input block (403) and writing of the output digital samples (354) from the current output block (407) are continued. Input window (451) with L samples is formed using the samples of the just-filled block (404) and the previous three blocks. These L samples are windowed with a window of length L and are copied to the input data buffer (405). These samples padded with N−L zero-valued samples serve as input (151) for processing. The spectral samples (160) obtained from the processing are stored in output data buffer (406). The S samples (454) are copied in write-to block (408) of the 2-block DMA output cyclic buffer (402).

To examine the effect of the processing parameters, the technique was implemented for offline processing using Matlab. Implementation was carried out using magnitude subtraction (exponent factor $\gamma=1$) as it showed higher tolerance to variation in the values of $\alpha$ and $\beta$. Processing was carried out with sampling frequency of 10 kHz and window length of 25.6 ms (i.e. L=256 samples) with 75% overlap (i.e. S=64 samples). As the processed outputs with FFT length N=512 and higher were indistinguishable, N=512 was used. The processing with $\tau=0.1$ and $\alpha=(0.9)^{1/1024}$, corresponding to rise time of one frame shift and a fall time of 1024 frame shift, was found to be the most appropriate combination for different types of noises and SNRs. Processing with these empirically obtained values and without spectral smoothening of the estimated noise spectrum was used for evaluation with informal listening and for objective evaluation with Perceptual Evaluation of Speech Quality (PESQ) measure. The PESQ score (scale: 0-4.5) is calculated from the difference between the loudness spectra of level-equalized and time aligned noise-free reference and test signals (ITU, "Perceptual evaluation of speech quality (PESQ): An objective method for end-to-end speech quality assessment of narrow-band telephone networks and speech codecs," *ITU-T Rec.*, P. 862, 2001). The speech material consisted of a recording with three isolated vowels, a Hindi sentence, and an English sentence (-/a/-/i/-/u/"aayiye aap kaa naam kyaa hai"—"where were you a year ago") from a male speaker. A longer test sequence was generated by speech-speech-silence-speech concatenation of the recording for informal listening test. Testing involved processing of speech with additive white, street, babble, car, and train noises at SNR of 15, 12, 9, 6, 3, 0, −3, −6, −9, and −12 dB.

To find the most suitable quantile for noise estimation and number of frames over which this quantile should be estimated, the offline processing was carried out using sample quantile. Processing significantly enhanced the speech for all noises and there was no audible roughness. For objective evaluation of the processed outputs, PESQ scores were calculated for the processed output with $\beta=0$, $\alpha$ in the range of 0.4 to 6, and with quantile p=0.1, 0.25, 0.5, 0.75, and 0.9. The quantile values were obtained using previous M frames, where M=32, 64, 128, 256, and 512. For fixed values of SNR, $\alpha$, and p, the highest PESQ scores were obtained for M=128. Lower values of M resulted in attenuation of speech signal and larger values were unable to track non-stationary noise. The investigations were repeated using dynamic quantile tracking. The PESQ scores of the processed output with convergence factor $\lambda=1/256$ were found to be nearly equal to the PESQ scores obtained using sample quantile with M=128. It was further observed that noise estimation with p=0.25 resulted in nearly the best scores for different types of noises at all SNRs.

Figure 5:
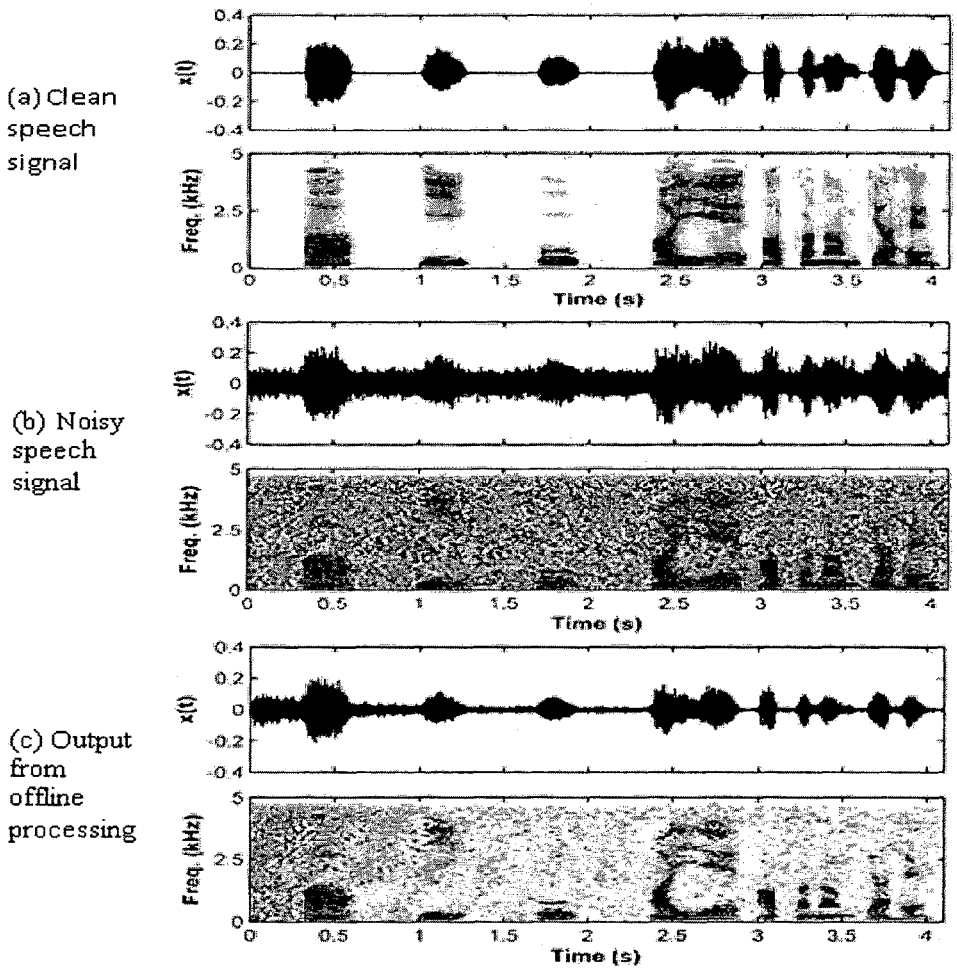
FIG. 5 shows an example of processing by the noise suppression system implemented for offline processing. Three different panels show (a) the unprocessed clean waveform and its spectrogram, (b) the noisy input waveform with white noise at SNR of 3 dB and its spectrogram, and (c) the processed output and its spectrogram.

FIG. 5 shows an example of processing by the noise suppression system implemented for offline processing. It shows the noise-free speech, noisy speech with white noise at SNR of 3 dB, and the processed output.

Figure 6:
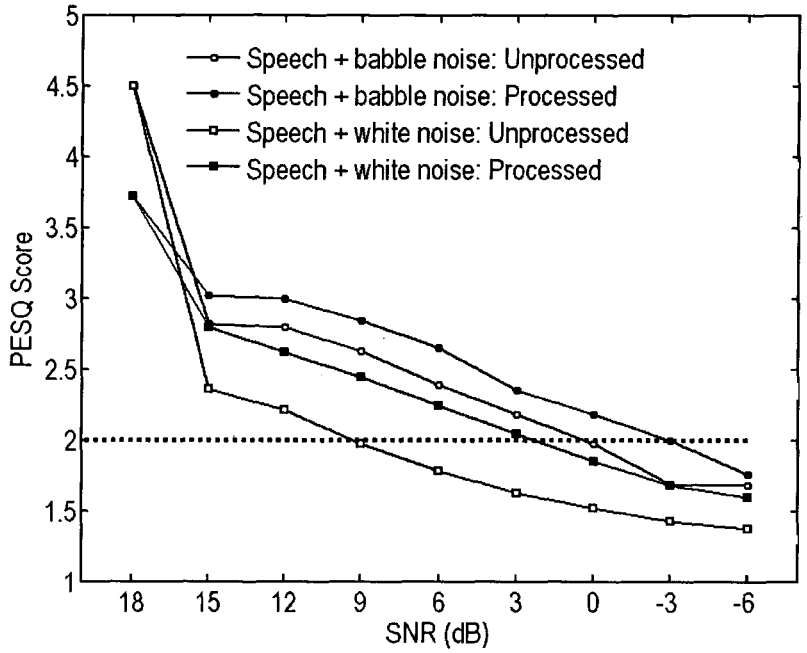
FIG. 6 shows the PESQ score vs. SNR plots of unprocessed and processed signals for speech signal added with white and babble noises.

FIG. 6 shows the PESQ score vs. SNR plots of unprocessed and processed signals for speech signal added with white and babble noises. For a score of 2 (generally considered as lowest score for acceptable speech), processing resulted in SNR advantage of approximately 6 dB for white noise and 3 dB for babble noise. SNR advantage for other types of noise was between these two values. Informal listening showed that spectral floor factor $\beta=0.001$ reduced the musical noise without degrading the speech quality.

Figure 7:
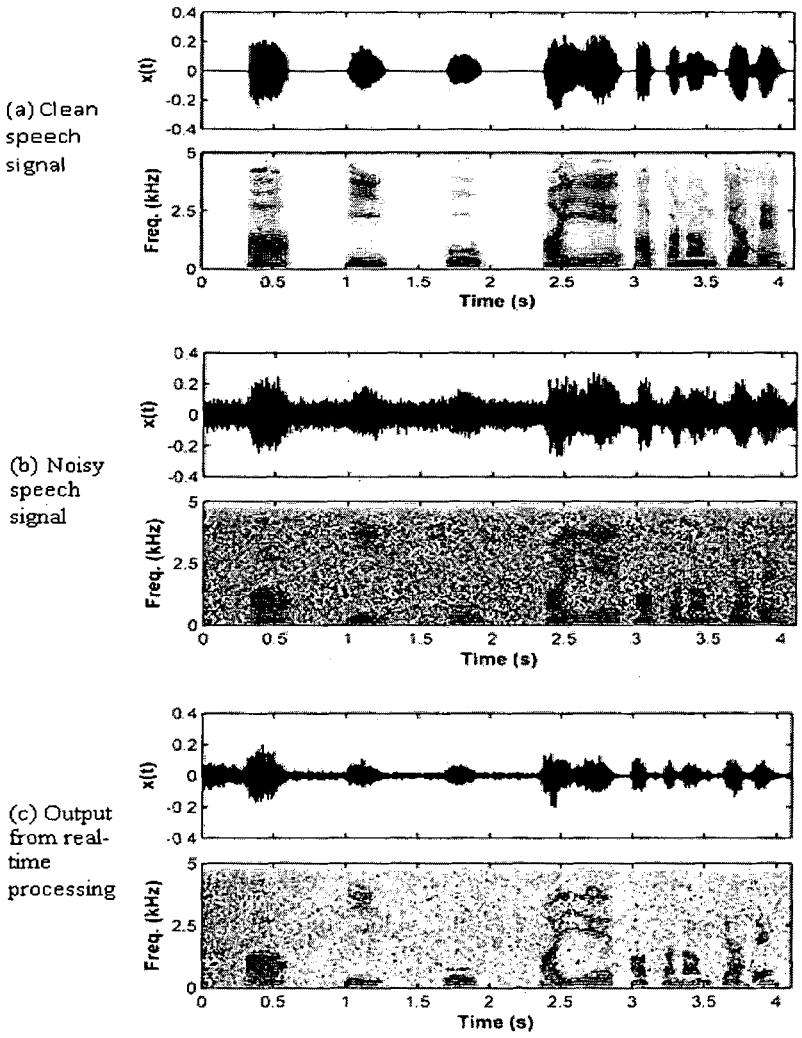
FIG. 7 shows an example of processing by the noise suppression system implemented for real-time processing. Three different panels show (a) the unprocessed clean waveform and its spectrogram, (b) the noisy input waveform with white noise at SNR of 3 dB and its spectrogram, and (c) the processed output and its spectrogram.

For real-time processing, the system schematically shown in FIG. 3 was implemented using the 16-bit fixed point processor TI/TMS320C5515 and audio codec TLV320AIC3204 available on the DSP board "eZdsp". This processor has DMA-based I/O, on-chip FFT hardware, and a system clock up to 120 MHz. The implementation was carried out with 16-bit quantization and at 10 kHz sampling frequency. The real-time processing was tested using speech mixed with white, babble, car, street, and train noises at different SNRs. FIG. 7 shows an example of processing showing the noise-free speech, noisy speech with white noise at SNR of 3 dB, and output from real-time processing. The output of the real-time processing was perceptually identical to that of offline processing. The match between the two outputs was confirmed by high PESQ scores (greater than 3.5) for real-time processing with offline processing as the reference. Total signal delay (consisting of algorithmic delay, computation delay, and input-output delay) was found to be approximately 36 ms which may be considered as acceptable for its use in the hearing aids along with lip-reading. An empirical test showed that the noise suppression system required approximately 41% of the processor capacity and the rest can be used in implementing other processing as needed for a hearing aid.

The preferred embodiment of the noise suppression system has been described with reference to its application in hearing aids and speech communication devices wherein the input and output signals are in analog form and the processing is carried out using a processor interfaced to an audio codec consisting of ADC and DAC with a single digital interface between the audio codec and the processor. It can be also realized using separate ADC and DAC chips interfaced to the processor or using a processor with on-chip ADC and DAC hardware. The system can also be used for noise suppression in speech communication devices with the digitized audio signals available in the form of digital samples at regular intervals or in the form of data packets by implementing the processing block (306) of FIG. 3 on the processor of the communication device or by implementing it using an auxiliary processor.

The disclosed processing method and the preferred embodiment of the disclosed processing system use FFT-based analysis-synthesis. Therefore the processing can be integrated with other FFT-based signal processing techniques like dynamic range compression, spectral shaping, and signal enhancement for use in the hearing aids and speech communication devices. Noise suppression can also be implemented using other signal analysis-synthesis methods like the ones based on discrete cosine transform (DCT) and discrete wavelet transform (DWT). These methods can also be implemented for real-time processing with the use of the disclosed method of approximation of quantile values by dynamic quantile tracking for noise estimation.

The above description along with the accompanying drawings is intended to describe the preferred embodiments of the invention in sufficient detail to enable those skilled in the art to practice the invention. The above description is intended to be illustrative and should not be interpreted as limiting the scope of the invention. Those skilled in the art to which the invention relates will appreciate that many variations of the described example implementations and other implementations exist within the scope of the claimed invention.

We claim:

1. A signal processing method to suppress background noise in a digitized input speech signal in hearing aids and speech communication devices, using analysis-modification-synthesis comprising the steps of:

performing a short-time spectral analysis by windowing of said digitized input speech signal for producing overlapping windowed segments as analysis frames and calculating a complex spectrum and a magnitude spectrum for each of said analysis frames;

estimating a noise spectrum from said magnitude spectrum by a quantile-based noise estimation, wherein a quantile value is calculated by dynamic quantile tracking, wherein said quantile value is calculated at each of said analysis frames by applying an increment or a decrement on its previous value, where the increment and decrement are selected to be a fraction of a dynamically estimated range of said magnitude spectral sample such that the calculated value approaches the sample quantile of said magnitude spectral sample over a number of successive analysis frames;

applying spectral subtraction for calculating an enhanced magnitude spectrum from said magnitude spectrum and said estimated noise spectrum after smoothening;

calculating an enhanced complex spectrum from said enhanced magnitude spectrum, said magnitude spectrum, and said complex spectrum; and resynthesizing a digital output signal by calculating an output segment from said enhanced complex spectrum, windowing of said output segment to obtain windowed output segment, and applying an overlap-add on said windowed output segment.

2. The method as claimed in claim 1, wherein the analysis-modification-synthesis is carried out using a modified Hamming window with 75% overlap as an input window for analysis and as an output window for synthesis.

3. The method for estimation of said noise spectral samples as claimed in claim 1, wherein a range of said magnitude spectral samples is dynamically estimated by updating a peak value and a valley value of said magnitude spectral samples using first-order recursive relations for the peak and the valley detection with rise and fall times selected for fast detection and low ripple.

4. The method for estimation of said noise spectral samples as claimed in claim 1, wherein frequency-dependent quantiles of said magnitude spectral samples are used for an effective suppression of the background noise in said digitized input speech signal.

5. The method as claimed in claim 1, wherein calculation of said enhanced magnitude spectrum, uses said estimated noise spectrum after smoothening by an averaging filter along a frequency axis, wherein the averaging filter is realized recursively.

6. The method as claimed in claim 1, wherein said enhanced complex spectrum is calculated by inputting together said complex spectrum, said magnitude spectrum, and said enhanced magnitude spectrum.

7. The method as claimed in claim 1, wherein noise is suppressed using an analysis-modification-synthesis based on a fast Fourier transform (FFT) and is integrated with other FFT-based signal processing used in the hearing aids and the speech communication devices.

8. The method as claimed in claim 1, wherein analysis-modification-synthesis is carried out using spectral representation.

9. A signal processing system for use in hearing aids and speech communication devices to suppress background noise in an analog input speech signal, comprising:

an analog-to-digital converter to convert an analog input speech signal to a digitized input speech signal and a digital-to-analog converter to convert a processed digital output signal as an analog output signal; and a digital processor interfaced to said analog-to-digital converter, and said digital-to-analog converter, and wherein the digital processor is configured to process said digitized input speech signal using analysis-modification-synthesis comprising the steps of:

performing a short-time spectral analysis by windowing of said digitized input speech signal for producing overlapping windowed segments as analysis frames and calculating a complex spectrum and a magnitude spectrum of said analysis frames;

estimating a noise spectrum from said magnitude spectrum by a quantile-based noise estimation, wherein a quantile value is calculated by dynamic quantile tracking, wherein each sample of said noise spectrum is estimated as the quantile value of a corresponding sample of said magnitude spectrum and wherein said quantile value is calculated at each of said analysis frames by applying an increment or a decrement on its previous value, where the increment and decrement are selected to be a fraction of a dynamically estimated range of said magnitude spectral sample such that the calculated value approaches the sample quantile of said magnitude spectral sample over a number of successive analysis frames;

applying spectral subtraction for calculating an enhanced magnitude spectrum from said magnitude spectrum and said estimated noise spectrum after smoothening;

calculating an enhanced complex spectrum from said enhanced magnitude spectrum, said magnitude spectrum, and said complex spectrum; and resynthesizing the digital output signal by calculating an output segment from said enhanced complex spectrum, windowing of said output segment to obtain windowed output segment, and applying an overlap-add on said windowed output segment.

10. The signal processing system as claimed in claim 9, wherein said digital processor comprises on-chip fast Fourier transform (FFT) hardware.

11. The signal processing system as claimed in claim 9, wherein the analog-to-digital converter and the digital-to-analog converter are configured for input and output, respectively, using direct memory access (DMA) and cyclic buffering for computational efficiency in analysis-modification-synthesis.

12. The signal processing system as claimed in claim 9, wherein said analog-to-digital converter and said digital-to-analog converter are integrated into an audio codec, wherein said audio codec is interfaced to said digital processor using single digital interface.

13. The signal processing system as claimed in claim 12, wherein said digital processor comprises on-chip analog-to-digital converter (ADC) and digital-to-analog converter (DAC).

* * * * *